United States Patent [19]

Deck

[11] Patent Number: 4,660,627

[45] Date of Patent: Apr. 28, 1987

[54] HEAT EXCHANGING WITH SLOWLY ROTATING FINNED ELEMENTS

[76] Inventor: Brent D. Deck, 24 Hopedale St., Hopedale, Mass. 01747

[21] Appl. No.: 833,210

[22] Filed: Feb. 25, 1986

Related U.S. Application Data

[63] Continuation-in-part of Ser. No. 631,097, Jul. 16, 1984, abandoned.

[51] Int. Cl.[4] ..... F28D 11/04; F28F 5/00

[52] U.S. Cl. ..... 165/86; 165/84; 165/95

[58] Field of Search ..... 165/5, 84, 86, 95, 94

[56] References Cited

U.S. PATENT DOCUMENTS 2,813,698 11/1957 Lincoln ..... 165/104.25 X
3,412,786 11/1968 Taylor ..... 165/5
3,721,217 3/1973 Willach et al. ..... 165/84 X
4,405,013 9/1983 Okamoto ..... 165/95 X

FOREIGN PATENT DOCUMENTS 0028986 2/1983 Japan ..... 165/95
665299 1/1952 United Kingdom ..... 165/86 H

*Primary Examiner*—Albert W. Davis, Jr.
*Assistant Examiner*—Randolph A. Smith
*Attorney, Agent, or Firm*—Charles Hieken

[57] ABSTRACT

A multiplicity of parallel heat transfer tubes each sealed with refrigerant are journaled for rotation at each end and in a bulkhead that separates the air flow channel in a counterflow heat exchanger into ingoing and outgoing parallel channels. Each heat transfer element has closely spaced circular fins extending radially outward from each tube, the spacing between adjacent fins being less than the fin radius. A motor and transmission cause each heat transfer element to rotate about its longitudinal axis.

22 Claims, 5 Drawing Figures

HEAT EXCHANGING WITH SLOWLY ROTATING FINNED ELEMENTS

This application is a continuation-in-part of application Ser. No. 631,097 filed July 16, 1984, now abandoned.

This invention relates to new and useful improvements in heat exchangers and, more particularly, heat exchangers of the finned tube in cross flow type.

BACKGROUND OF THE INVENTION

A search of the prior art uncovered U.S. Pat. Nos. 1,844,308, 3,344,854, 3,989,101, 4,066,119, 4,076,072 and 4,405,013. U.S. Pat. No. 3,344,854 discloses an engine radiator having a movable endless belt screen around the heat exchanger for preventing clogging of heat exchangers by foreign particles entrained in the cooling medium.

SUMMARY OF THE INVENTION

According to the invention, there is heat exchanging apparatus comprising a plurality of substantially parallel heat transfer elements each having a plurality of closely spaced heat radiating fins extending radially outward from the element axis, means for rotatably supporting the heat transfer elements at at least one end and intermediate the ends in a dividing member that divides the heat exchanging apparatus into portions for receiving air flow perpendicular to the plane of the substantially parallel elements in opposite directions so that air flowing in one of the directions releases heat to the heat transfer elements that is absorbed by the air moving in the opposite direction so that rotation of the elements allows particles stuck to fins upon entering to be expelled by the air flow over them as the fin portion bearing the stuck particles advances from the upstream to the downstream side of the incident air stream. Preferably, there is means, such as a motor and transmission means for coupling the motor to the rotatable heat transfer elements for rotating the heat transfer elements. Preferably, the heat transfer elements comprise conducting tubes sealed with refrigerant, such as Freon refrigerant.

The general object of this invention is to provide a simple means of manufacturing a heat exchanger which, when placed in the flow of a fluid laden with suspended lint or other complex contaminant particles, will be generally self cleaning and nonclogging.

Other important objects of this invention are to provide a heat exchanger of the type with low power consumption, and low labor requirement in the cleaning process.

Additional objects of this invention are to provide a heat exchanger of the type with low costs of manufacture, installation, and maintenance.

An additional object of this invention is to provide a heat exchanger of the type which is mechanically simple and reliable.

A further object of the invention is to produce an exchanger of the type wherein high fin densities needed for high thermal performance do not adversely affect the nonclogging nature of the device.

Still another object of this invention is to provide a heat exchanger of the type without need for external filtration and with total design flexibility with respect to size.

These, together with other objects and advantages which will become subsequently apparent, reside in the details of construction and operation as more fully hereinafter described and claimed, reference being had to the accompanying drawings forming a part hereof and in which:

DESCRIPTION OF THE PREFERRED EMBODIMENTS

Figure 1:
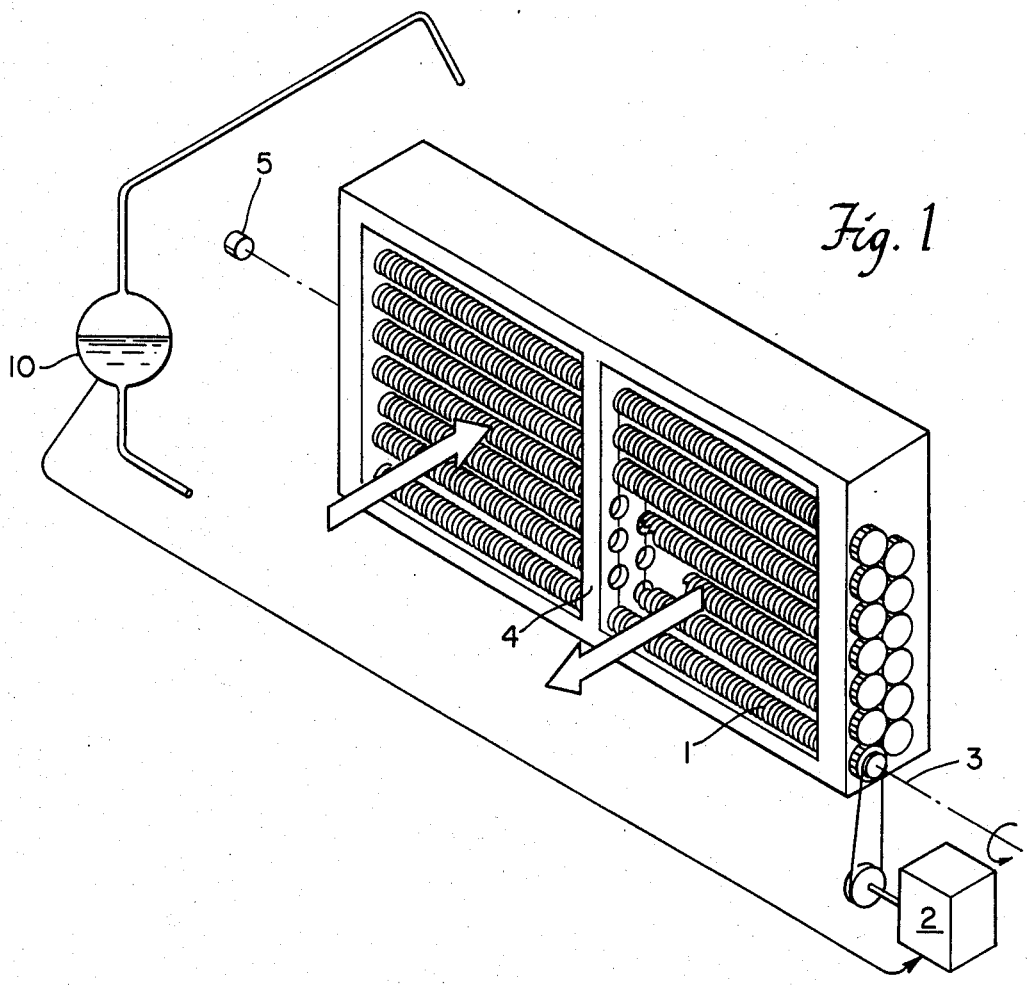
FIG. 1 is a perspective view of a heat exchanger in a typical embodiment for air to air heat recovery.

Referring now to the drawing in detail and more particularly FIG. 1, a feature of the invention is the rotating heat transfer elements 1, of a suitable material, which, being driven by suitable transmission means 2, rotates about an axis 3.

FIG. 1 shows one basic embodiment in which each heat transfer element 1 is a discrete sealed circular cylindrical tube with transverse circular external fin means. The heat transfer element is charged with a refrigerant, such as Freon, which provides heat transfer means by evaporating throughout part of the length of the heat transfer element and condensing elsewhere along the length of the element.

When these heat transfer elements are exposed to, for instance, a flow of exhaust air from a laundry drier, the leading or upstream edges of these fins catch and hold a certain amount of the lint in the airstream. As each heat transfer element 1 rotates about its axis, these leading edges with their buildup of lint move to the area of high air velocity between the tubes and then to the rear of the tubes, during which rotation the same air flow which initially deposited the lint acts to remove the lint from the fins then trailing or downstream edges. The separation between adjacent fins is significantly less than the span across each fin between extreme upstream and downstream points on leading and trailing edges, respectively.

Where the heat exchanger consists of a number of banks of heat transfer elements 1 situated sequentially with respect to the air flow, lint will move from one bank to the next and finally out of the heat exchanger after being removed from the final bank.

This self cleaning system allows all debris in the air flow to pass through the heat exchanger, and it eliminates the need for filtering prior to the heat exchanger. Thus eliminated is the need to clean filters and remove the waste from filter cleaning collection points. This represents a significant savings in man hours to the user, and also a savings in electrical energy to run compressors or other mechanical devices commonly used in the self cleaning filters and air jet or water jet cleaning systems in heat exchangers. The energy required to rotate the heat transfer elements in the current invention is minimal in comparison with that to run air compressors or water pumps.

In the preferred embodiment, the heat exchanger is an air-to-air heat recovery system wherein a bulkhead 4 with journal bearing means separates the exhaust air flow from the makeup air flow. Differential pressure sensing switch 10 via conduits to ducting on either side of the exhaust portion of the heat exchanger, may activate a mechanical power means in the form of a simple low powered geared reduction electric motor assembly 2, which rotates the heat transfer elements slowly via the transmission means in the form of gears, pullies, chain drives, or other standard transmission means. Depending on the application, this differential pressure switch may be set to operate whenever any differential pressure is detected, or with the use of appropriate standard relays and time delays, may be used to rotate the elements only when an excessive pressure drop indicating clogging is detected.

If additional cleaning means are required, a preferred method is the appropriate placement of sonic transducers such as 5 about the heat exchanger, for instance, at the end of each heat transfer element, which will additionally help to loosen lint from on or between fins and allow it to be blown free by the normal air flow.

Figure 2:
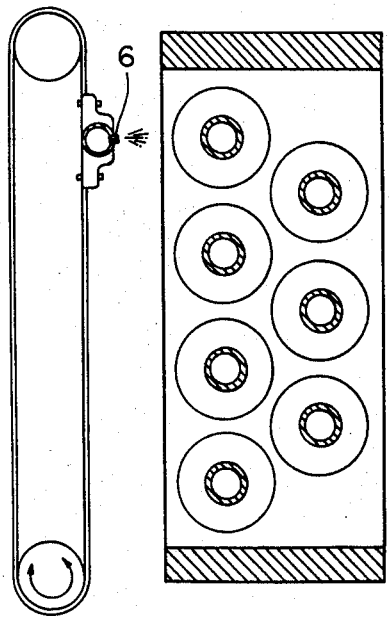
FIGS. 2 and 3 are transverse sectional views of various embodiments of the invention utilizing additional means for cleaning with the heat exchange elements.

In FIG. 2 the cleaning action provided by the exhaust air stream over the rotating heat transfer elements is augmented by a more traditional cleaning method, for example an air jet 6. In this embodiment, the air jet means, activated periodically, merely loosens whatever material was not blown free by the exhaust air stream, allowing it to be removed in the normal manner by the exhaust air stream and subsequent rotating elements. This substantial improvement over previous uses of air jets for cleaning finned tubes eliminates the need to collect the freed lint at each bank of elements.

Figure 3:
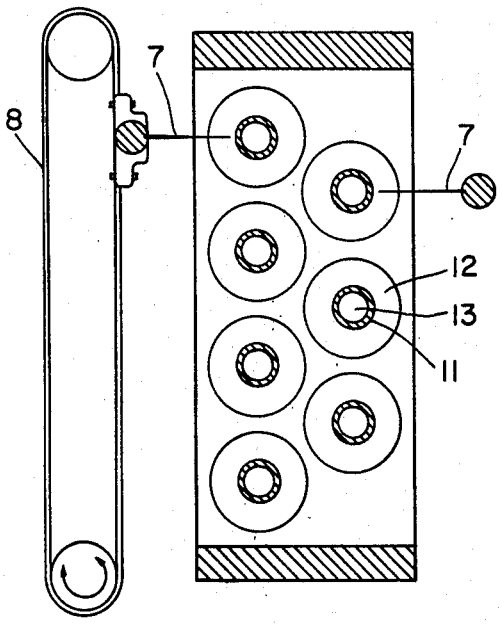

In FIG. 3 the cleaning action of the exhaust air stream over the rotating elements is augmented by mechanical brush means 7 on an endless belt 8. In one embodiment the brush means intermittently or constantly traverse one or more banks of rotating elements. In another embodiment brush means are fixed with respect to individual heat transfer elements. And still another embodiment brush means may move in other ways, for instance rotating about their longitudinal axes, whether in a fixed or traversing configuration.

The advantage to such embodiments over brush means on nonrotating elements is that in the present invention the brush means need only loosen the clogging material, and not remove it completely. Once loosened the rotating heat transfer elements and air flow through the heat exchanger will cause removal of the clogging materials.

Other mechanical cleaning systems will be apparent to those skilled in the art, for instance pressurized water jet means or steam cleaning means, but in all cases the cleaning action of these additional systems is enhanced by the action of the rotating elements in the air flow.

Figure 4:
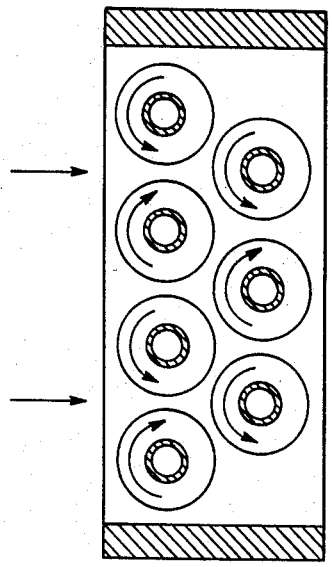
FIGS. 4 and 5 are transverse sectional views showing adjacent elements arranged to rotate in opposite directions.
Figure 5:
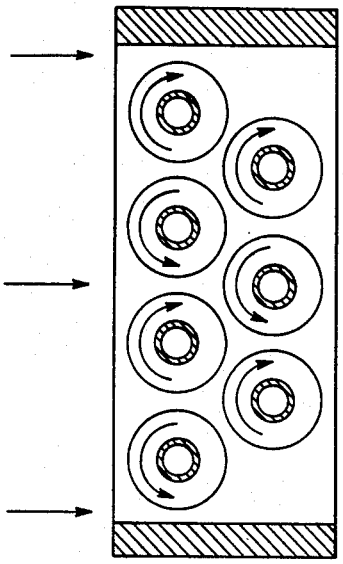

Referring to FIGS. 4 and 5, there are shown embodiments of the invention in which adjacent elements rotate in opposite directions as indicated by the arrow on each element. As indicated above each heat transfer element rotates slowly. By slowly rotating each element as is evident from the use of a low powered gear reduction motor assembly used in a practical system, the velocity of air flow is significantly greater than the tangential velocity of a piece of lint on a rotating thin tip.

Having the transmission means rotate each adjacent pair of heat transfer elements oppositely helps roll large clumps of lint through a pair of elements to the next bank of heat transfer elements. To help insure that clumps of lint are not trapped in alternate gaps between heat transfer elements, the mechanical power source or transmission device may include means for periodically changing the direction of rotation of the heat transfer elements.

The present invention has several advantages over the prior art in the areas of simplicity, flexibility, and effectiveness in keeping heat transfer surfaces clean.

Vehicle radiators having first and second opposed surfaces in the prior art exemplified by U.S. Pat. Nos. 4,066,119 and 4,076,072 lose performance during the rotation process, and thus can not provide continuous self cleaning without a significant penalty. In the present invention, the rotation of the heat transfer elements creates no changes in the heat transfer surface or frontal area. Additionally, in the present invention the bulk of the lint is removed as the lint passes through the high velocity area in the gaps between adjacent heat transfer elements. The prior art does not teach this benefit.

U.S. Pat. No. 4,405,013 discloses a rotor made up of a plurality of heat pipes with no motion of one heat pipe rotationally relative to another. This apparatus has the disadvantage that an accumulation of lint or other complex material trapped between rows of heat pipes (if they are closely spaced heat pipes) will merely be tossed back and forth between two banks of heat pipes as the direction of flow alternates during the rotation. In the present invention the flow direction is constant with respect to the banks of heat pipes, and the rotational action of the individual heat pipes with respect to one another aids in the freeing of lint. Additionally, the pesent invention allows the heat pipes to remain fixed with respect to the temperature gradient in the air flow, thereby providing maximum thermal effectiveness duplicating that of pure counterflow heat exchange. The prior art apparatus loses the benefits of counterflow heat exchange as the heat pipes move throughout the temperature gradient of the air flow.

U.S. Pat. No. 2,813,698 discloses a heat exchanger having rotating heat elements with disks that spin in hot gases at high velocity to improve heat transfer when operating in high temperature air streams. The high rotational velocity also throws off soot particles which may gather on the spinning disks.

This patent and the other prior art does not address the problem of lint, such as that in the air stream of a laundry dryer at significantly lower temperature than the 2300° F. mentioned in this patent. Lint differs from other solids found in airstreams in a number of ways. The volume of space defined by a lint fiber is orders of magnitude greater than the actual volume of the lint itself. That is, a lint fiber is long and twisted, defining a large three-dimensional space, compared to a speck of soot, which is a simple shape of comparatively high density. Lint has the capacity to form large mats of randomly interlocked fibers.

The present invention operates at a rotational speed about one revolution per minute, believed to be about 1000 times slower than the apparatus in U.S. Pat. No. 2,813,698. Lint is lodged on the leading edge of the rotating element fins and slowly rotated to the position of maximum air velocity discussed above, where the lint is blown from the fins. Furthermore, the counter rotating elements shown in the embodiments of FIGS. 4 and 5 may function to roll large mats of lint through the heat exchanger system as sometimes may be desirable.

The individually installed nature of the heat pipes in the present invention allows for a greater ease of removal and replacement, and also allows for total flexibility in the size and shape of the heat exchanger. A fixed pattern of parallel banks is economically preferable and structurally preferable to radially dispersed concentric banks fixed to a rotating support structure.

Tests have shown the configuration of parallel banks of thin tubes described in the present invention to generate extremely low pressure drops in the air flow in comparison with other commercially available heat exchangers of similar thermal performance.

A benefit of the present invention with respect to the prior art is that higher fin densities along the length of the heat transfer elements, which higher densities are desirable to produce higher thermal performance, actually improve the clog free nature and cleanability of the exchanger by increasing the chances of the lint particles being caught on the leading edges of the fins rather than wedging between the fins, after which the rotation of the elements causes the previously described removal of the linty material.

Manufacture of the claimed exchanger is not limited to the materials or processes described above. Other methods are suitable. Transmission means, for instance may range from automatically controlled powered system for commercial applications to a manually powered system wherein the home owner manually rotates each element or gang of elements in a small system attached to a home laundry dryer.

The foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to if they fall within the scope of the invention as claimed.

What is claimed is:

1. Heat exchanging apparatus comprising, a plurality of substantially parallel heat transfer elements each having a longitudinal axis in a plane perpendicular to the normal direction of fluid flow therethrough, a source of a fluid having lint particles and moving in a flow direction, means for supporting said heat transfer elements for intercepting said moving fluid for heat exchange therewith in said flow direction having a major component substantially perpendicular to said plane, said fluid having lint particles which if allowed to accumulate would clog said heat exchanging apparatus and obstruct the flow of said fluid therethrough, each heat transfer element having a plurality of fin means extending radially outward from an element longitudinal axis for increasing the heat transfer between said fluid and each heat transfer element, means for rotatably supporting each of said heat transfer elements for rotation about the longitudinal axis of each for allowing rotation of each heat transfer element about its longitudinal axis to change points on said fin means between a range of positions between downstream and upstream points, means for producing fluid flow in said flow direction to exchange heat with said heat exchange elements, lodge lint particles on said upstream points and clean particles from said downstream points by the action of said fluid flowing through said fin means in said flow direction, and means for slowly continuously rotating said heat transfer elements at a rate of the order of one revolution per minute about the longitudinal axis of each while said fluid flows in said flow direction through said fin means and exchanges heat with said heat exchanging apparatus, said lint particles being attached to said upstream points from said fluid when said fluid enters said fin means and cleaned from said downstream points by said fluid flow to prevent said lint particles from accumulating in said heat exchanging apparatus.

2. Heat exchanging apparatus in accordance with claim 1 and further comprising transmission means coupled to each of said heat transfer elements for rotating each heat transfer element about its longitudinal axis.

3. Heat exchanging apparatus in accordance with claim 2 and further comprising, a source of motive power coupled to said transmission means for providing mechanical power to slowly rotate each heat transfer element about its longitudinal axis.

4. Heat exchanging apparatus in accordance with claim 2 wherein each of said heat transfer elements comprises a sealed cylindrical tube charged with refrigerant.

5. Heat exchanging apparatus in accordance with claim 2 wherein said fin means comprises a plurality of closely spaced radial fins with adjacent fins spaced sufficiently close together to block a significant number of lint particles at the fin edges at the upstream end of the fluid flow to facilitate removal when the particles move toward the downstream side upon slow rotation of the associated heat transfer element.

6. Heat exchanging apparatus in accordance with claim 2 wherein said transmission means includes means for slowly rotating adjacent heat transfer elements in opposite directions.

7. Heat exchanging apparatus in accordance with claim 3 wherein each of said heat transfer elements comprises a sealed cylindrical tube charged with refrigerant.

8. Heat exchanging apparatus in accordance with claim 3 wherein said fin means comprises a plurality of closely spaced radial fins with adjacent fins spaced sufficiently close together to block a significant number of lint particles at the fin edges at the upstream end of the fluid flow to facilitate removal when the lint particles move toward the downstream side upon slow rotation of the associated heat transfer element.

9. Heat exchanging apparatus in accordance with claim 3 and further comprising means for periodically changing the direction of slow rotation of said heat transfer elements.

10. Heat exchanging apparatus in accordance with claim 1 wherein each of said heat transfer elements comprises a sealed cylindrical tube charged with refrigerant.

11. Heat exchanging apparatus in accordance with claim 10 wherein said fin means comprises a plurality of closely spaced radial fins with adjacent fins spaced sufficiently close together to block a significant number of lint particles at the fin edges at the upstream end of the fluid flow to facilitate removal when the lint particles move toward the downstream side upon slow rotation of the associated heat transfer element.

12. Heat exchanging apparatus in accordance with claim 1 and further comprising, means for sensing a pressure differential across said heat transfer elements in response to fluid flow thereacross.

13. Heat exchanging apparatus in accordance with claim 1 and further comprising, air jet means for directing cleaning fluid to at least a portion of said heat transfer elements.

14. Heat exchanging apparatus in accordance with claim 13 and further comprising, means for relatively displacing said air jet means and said heat transfer elements.

15. Heat exchanging apparatus in accordance with claim 1 and further comprising, mechanical brush means for brushing the rotating heat transfer elements to coact therewith and create a shearing action.

16. Heat exchanging apparatus in accordance with claim 15 and further comprising, means for relatively displacing said mechanical brush means and said heat transfer elements in a direction generally parallel to said longitudinal axes.

17. Heat exchanging apparatus in accordance with claim 1 and further comprising, vibration inducing means coupled to said heat transfer element for loosening particles attached to said fin means.

18. Heat exchanging apparatus in accordance with claim 17 and further comprising, means for positioning said vibration inducing elements adjacent to ends of said heat transfer elements.

19. Heat exchanging apparatus in accordance with claim 1 wherein said means for supporting comprises baffle means perpendicular to said longitudinal axes dividing said heat exchanging apparatus into parallel inflow and outflow channels with fluid flowing through one of said channels delivering heat to said heat transfer elements while fluid flowing through the other of said channels withdraws heat from said heat transfer elements.

20. Heat exchanging apparatus in accordance with claim 1 wherein said fin means comprises a plurality of closely spaced radial fins with adjacent fins spaced sufficiently close together to block a significant number of lint particles at the fin edges at the upstream end of the fluid flow to facilitate removal when the particles move toward the downstream side upon rotation of the associated heat transfer element.

21. Heat exchanging apparatus in accordance with claim 20 wherein the spacing between adjacent finned elements is significantly less than the span across each fin of said finned elements between extreme upstream and downstream points to create significantly increased fluid velocity through the space between adjacent finned elements.

22. A method of cleaning finned heat transfer elements in heat exchanging apparatus comprising a plurality of substantially parallel heat transfer elements each having a longitudinal axis in a plane perpendicular to the normal direction of fluid flow therethrough, a source of a fluid having lint particles, means for supporting said heat transfer elements for intercepting fluid flow for heat exchange therewith in a flow direction having a major component substantially perpendicular to the longitudinal axis of each heat transfer element, said fluid having lint particles which if allowed to accumulate would clog said heat exchanging apparatus and obstruct the flow of said fluid therethrough, each heat transfer element having a plurality of fin means extending radially outward from an element longitudinal axis for increasing the heat transfer between said fluid and each heat transfer element, and means for rotatably supporting each of said heat transfer elements for rotation about the longitudinal axis of each for allowing rotation of each heat transfer element about its longitudinal axis to change points on said fin means between a range of positions between downstream and upstream points which method includes the steps of, directing said fluid across said heat transfer elements in a direction having a component that is predominantly perpendicular to said plane to effect heat transfer between said fluid and said elements, lodge lint particles on said upstream points and clean lint particles from said downstream points by the action of said fluid flowing through said fin means in said flow direction, and slowly continuously rotating said heat transfer elements at a rate of the order of one revolution per minute about said longitudinal axes while said fluid flows in said flow direction through said fin means and exchanges heat with said heat exchanging apparatus to prevent said lint particles from accumulating in said heat exchanging apparatus.

* * * * *